US006990829B2

(12) United States Patent
Hall et al.

(10) Patent No.: US 6,990,829 B2
(45) Date of Patent: Jan. 31, 2006

(54) AIR CYCLE HVAC SYSTEM HAVING SECONDARY AIR STREAM

(75) Inventors: Timothy James Hall, Novi, MI (US); Wayne Charles Schnaidt, Novi, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 47 days.

(21) Appl. No.: 10/652,767

(22) Filed: Aug. 29, 2003

(65) Prior Publication Data

US 2005/0044876 A1 Mar. 3, 2005

(51) Int. Cl.
*F25D 9/00* (2006.01)
*F25D 21/14* (2006.01)

(52) U.S. Cl. ..... 62/401; 62/288; 62/427

(58) Field of Classification Search ..... 62/88, 62/172, 401, 402, 288, 427; 165/41, 42, 165/164, 165

See application file for complete search history.

(56) References Cited

U.S. PATENT DOCUMENTS

| | | | | |
|---|---|---|---|---|
| 3,877,245 | A | 4/1975 | Edwards | |
| 3,913,351 | A * | 10/1975 | Edwards | 62/402 |
| 3,967,466 | A | 7/1976 | Edwards | |
| 4,015,438 | A * | 4/1977 | Kinsell et al. | 62/88 |
| 4,517,813 | A | 5/1985 | Eggebrecht et al. | |
| 6,041,615 | A | 3/2000 | Ostersetzer et al. | |
| 6,381,973 | B1 * | 5/2002 | Bhatti et al. | 62/172 |
| 6,484,525 | B1 | 11/2002 | Piao et al. | |
| 6,622,499 | B1 * | 9/2003 | Gielda et al. | 62/172 |

* cited by examiner

*Primary Examiner*—Cheryl Tyler
*Assistant Examiner*—Richard L. Leung
(74) *Attorney, Agent, or Firm*—Brinks Hofer Gilson & Lione

(57) ABSTRACT

An air cooling system is provided for cooling ambient or recirculated air. The system includes a compressor receiving ambient air, and a first heat exchanger receiving pressurized air from the compressor. An expander receives warm air from the first heat exchanger. A second heat exchanger receives cold air from the expander. The second heat exchanger also receives supplemental ambient air, and is structured to utilize the cold air to cool the supplemental air and provide mixed cool air. The system cools and dehumidifies the supplemental ambient air to prevent unwanted stratification and condensation.

24 Claims, 3 Drawing Sheets

AIR CYCLE HVAC SYSTEM HAVING SECONDARY AIR STREAM

FIELD OF THE INVENTION

The present invention relates generally to air cooling systems, and more particularly relates to open loop air cycle systems having a secondary air stream.

BACKGROUND OF THE INVENTION

An air cycle HVAC system typically employs a compressor, a heat exchanger, and an expander in an open loop system to generate cold air. These air cooling systems are currently commonly found in aircrafts. The compressor receives ambient air and pressurizes the same causing the air to become hot. The heat exchanger dissipates some of the heat in the air exiting the compressor. The air then flows through the expander which removes work and brings the air back to atmospheric pressure, resulting in cold air which can be supplied to the passenger cabin.

In such an air cycle system, there may be times when additional air is needed to increase the total air flow of the system. Generally, prior solutions have been to provide a secondary air flow of ambient air that is immediately mixed with the cold air from the air cycle to meet the demands on the system. Unfortunately, the secondary flow of ambient air is relatively humid, and may condense on the interior of the cockpit, such as on the inside surface of the windows. Further, the two separate air streams will result in hot and cold stratification in the air distribution system. Accordingly, there exists a need to provide an air cycle system that can provide an increased total air flow of the system while preventing unwanted condensation and hot and cold stratification.

BRIEF SUMMARY OF THE INVENTION

The present invention provides an air cooling system for cooling ambient air. The system includes a compressor receiving ambient air, and a first heat exchanger receiving pressurized air from the compressor. An expander receives warm air from the first heat exchanger. A second heat exchanger receives cold air from the expander. The second heat exchanger also receives supplemental ambient air, and is structured to utilize the cold air to cool the supplemental air and provide mixed cool air.

According to more detailed aspects, the second heat exchanger generally includes a first plurality of passageways receiving the cold air and a second plurality of passageways receiving the supplemental ambient air. The first and second plurality of passageways are proximate each other to effectuate heat transfer. The second plurality of passageways preferably include corrugations or fins to provide turbulent flow to the supplemental ambient air. The second heat exchanger may further include a manifold receiving the cold air and distributing the cold air to the first plurality of passageways. The manifold is elongated and includes an inlet end, and tapers as the manifold extends away from the inlet. Stated another way, the volume of the manifold decreases in relation to the distance from the inlet for equal flow distribution.

The second heat exchanger preferably defines a discharge surface, and the cold air and supplemental ambient air exit the second heat exchanger proximate the discharge surface. The heat exchanger is preferably structured to promote mixing of the cold air with the supplemental ambient air.

This also allows dehumidification of the supplemental ambient air and the moisture runs down the discharge surface, and more particularly the face of the fins in the second plurality of passageways.

BRIEF DESCRIPTION OF THE DRAWINGS

The accompanying drawings incorporated in and forming a part of the specification illustrate several aspects of the present invention, and together with the description serve to explain the principles of the invention. In the drawings.

DETAILED DESCRIPTION OF THE INVENTION

Figure 1:
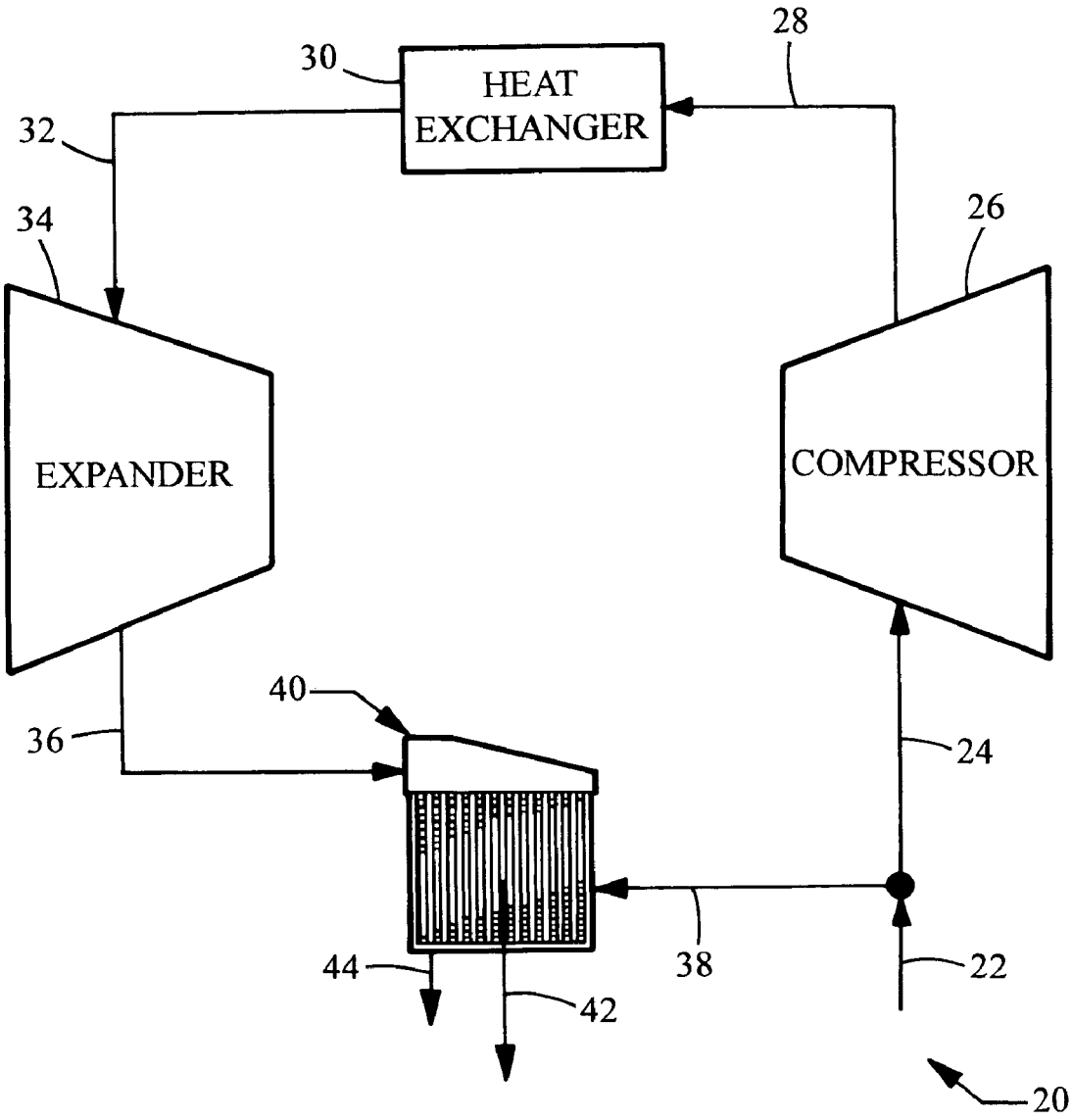
FIG. 1 is a schematic depicting an air cooling system constructed in accordance with the teachings of the present invention.

Turning to the figures, FIG. 1 depicts a schematic of the air cycle defined by the air cooling system 20 constructed in accordance with the teachings of the present invention. The cooling system 20 has been constructed for use in an automotive vehicle, although other environments which require air cooling may also employ the present invention. The system 20 generally utilizes ambient air indicated by arrow 22, which is typically taken from the exterior of the vehicle. However, it will be recognized by those skilled in the art that the ambient air 22 may also be replaced by recirculated air from within the vehicle, and hence as used herein ambient air is also intended to include recirculated air.

The ambient air 22 is routed to a compressor 26 as indicated by arrow 24. The compressor pressurizes the ambient air 22, and in turn heats the same. The pressurized air 28 is provided to a first heat exchanger 30 as indicated by the arrow in FIG. 1. The heat exchanger 30 dissipates some of the heat, and provides high pressure warm air 32 to the expander 34. The compressor 26, heat exchanger 30 and expander 34 are all of general construction as is well understood in the art.

Upon passing through the expander 34, cold air 36 emerges and would normally be used by the system 20 within the passenger compartment of a vehicle. However, according to the present invention the cold air 36 is sent to a second heat exchanger 40. The second heat exchanger 40 is of a novel construction as will be discussed in further detail below. Suffice it to say at this point that the heat exchanger 40 utilizes secondary or supplemental ambient air 38 in order to increase the total air flow of cooled dehumidified air 42 to the passenger cabin. The heat exchanger 40 is also structured to remove moisture 44 from the supplemental ambient air 38 as will be further discussed herein.

Figure 2:
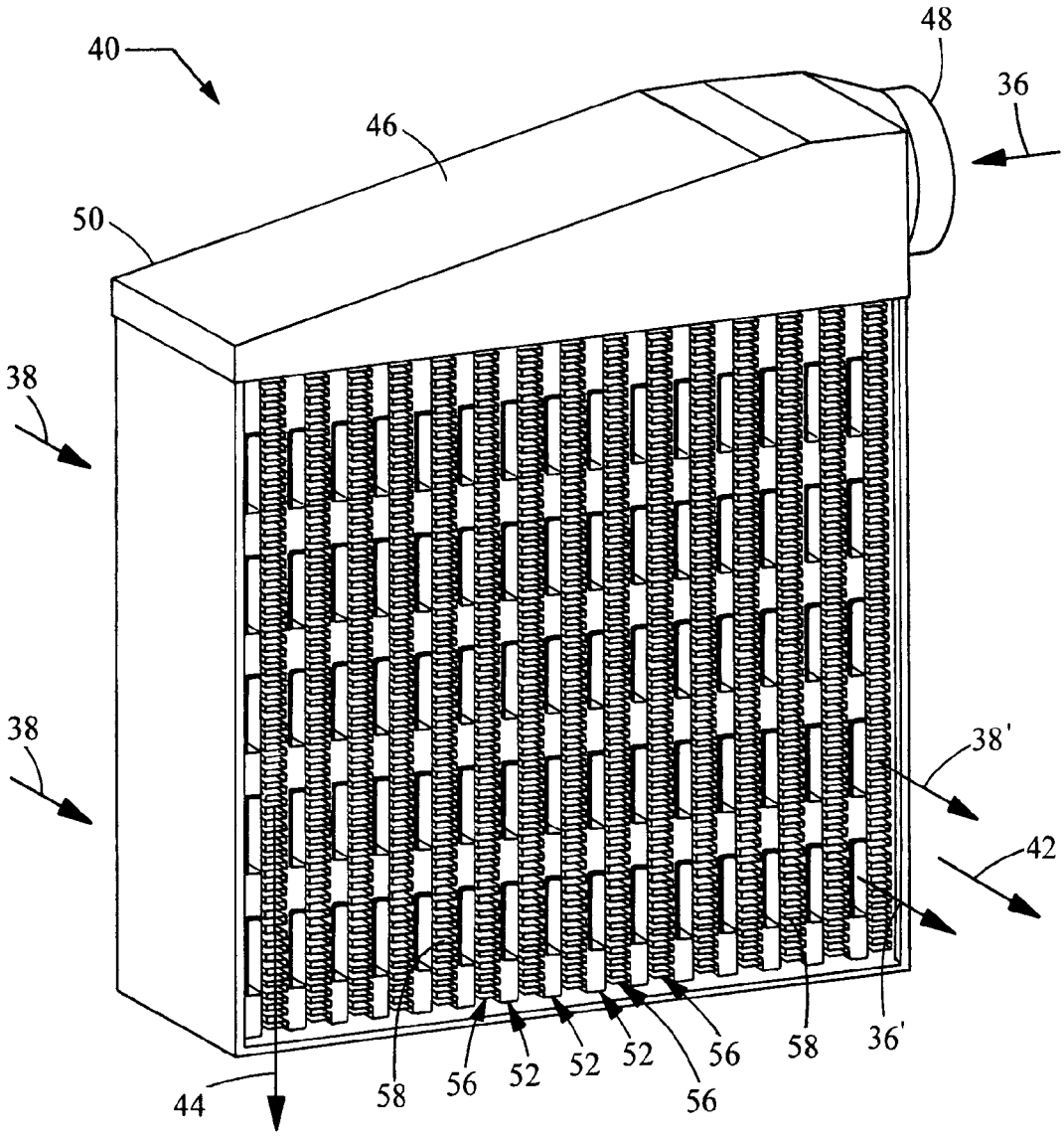
FIG. 2 is perspective view of a heat exchanger forming a portion of the air cooling system depicted in FIG. 1.

Turning now to FIG. 2, the second heat exchanger 40 has been depicted in perspective view. As previously indicated, the heat exchanger 40 receives cold air 36 from the expander 34 via a manifold 46 having an inlet 48. The cold air 36 is typically dehumidified through the normal air cycle (i.e. via compressor 26, heat exchanger 30 and expander 34). The heat exchanger 40 also receives supplemental ambient air 38 as indicated by the arrows. The additional ambient air 38 simply blows through a rear side face (not shown) of the heat exchanger 40.

The heat exchanger 40 generally includes a first plurality of passageways 52 for receiving and distributing the cold air 36 received and the manifold 46. Further, the heat exchanger 40 includes a second plurality of passageways 56 for receiving and distributing the supplemental ambient air 38. The first plurality of passageways 52 are located proximate the second plurality of passageways 56 such that the cold air 36 is utilized to remove heat from the ambient air 38. By way of this operation, two important objects are achieved. First, the ambient air 38 is cooled, to limit stratification of the air supply to the passenger cabin. Furthermore, humidity in the ambient air 38 is removed, thereby minimizing the potential for condensation within the passenger compartment, and especially on the windows of the vehicle.

Figure 3:
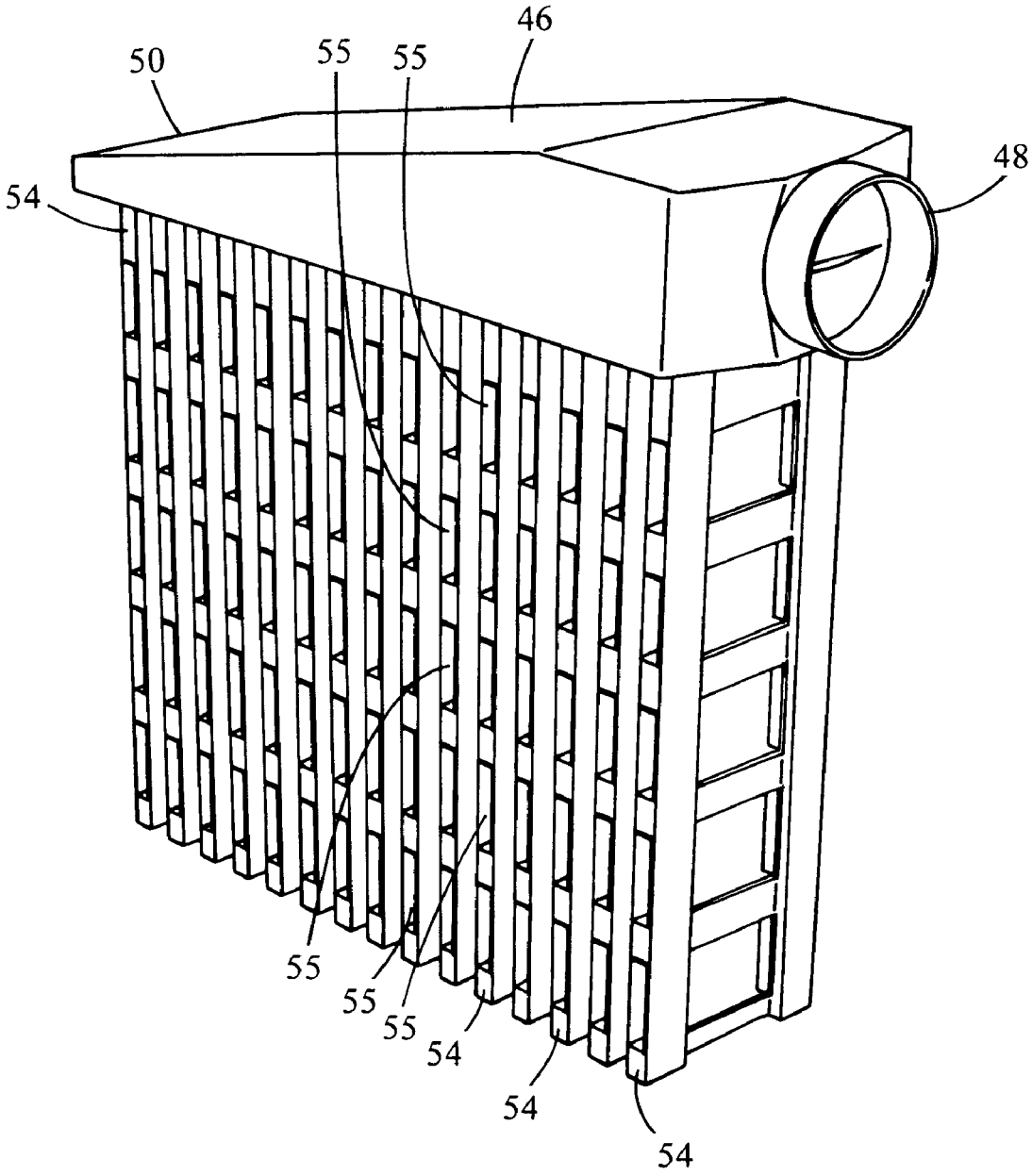
FIG. 3 is a perspective view of a portion of the heat exchanger depicted in FIG. 2.

FIG. 3 provides a more detailed view of the inner construction of the heat exchanger 40. As shown, the manifold 46 is elongated and includes an inlet 48 at one end. The opposing end 50 of the manifold 46 is closed, and the manifold 46 tapers as it flows from the inlet end 48 to the opposing end 50. Stated another way, the volume within the manifold 46 decreases as the manifold extends away from the inlet 48. In this way, uniform distribution of the cold air 36 is provided.

The plurality of first passageways 52 are defined by a plurality of tubes 54. The tubes 54 are shown as generally flat in shape, although they may comprise any shape depending upon the particular application. Each tube 54 has at least one exit opening 55 for directing the cold air 36' (FIG. 2) outward from a discharge face 60 defined on one side of the heat exchanger 40. Turning back to FIG. 2, the second plurality of passageways 56 are located in between each of the tubes 54 defining the first plurality of passageways. The second plurality of passageways 56 are generally comprised by a corrugated or finned surface 58. The corrugations or fins 58 define a torturous pathway which imparts turbulent flow to the supplemental ambient air 38 flowing through the heat exchanger 40 for improved heat transfer.

As is known in the art, by positioning the first plurality of passageways 52 proximate the second plurality of passageways 56, the relatively warm and humid supplemental ambient air 38 is cooled by the cold air 36 flowing through the tubes 54. As indicated by arrow 36', the cold air exits the outlets 55 of tubes 54 proximate the partially cooled air 38' exiting the fins 58. The heat exchanger 40 is structured such that the cold air 36' and partially cooled air 38' mix to form cool air 42 to be used within the passenger compartment. That is, the supplemental ambient air 38 is first cooled within the second heat exchanger 40, and then is further cooled by being mixed with cold air 36'. Both the cold air and the supplement ambient air exit the second heat exchanger 40 proximate the discharge surface 60.

Furthermore, it will be recognized that by virtue of passing the ambient air 38 proximate the cold dry air 36, moisture will be removed from the ambient air 38. The moisture will be forced to the discharge surface 60 and will flow down the face of the fins 58 as indicated by arrow 44. That is, the force of gravity will direct the moisture 44 down the discharge face 60 at the fins 58, and the moisture 44 will flow and fall from the bottom of the heat exchanger 40.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. An air cooling system for cooling ambient air comprising:

a compressor receiving ambient air;

a first heat exchanger receiving pressurized air from the compressor; an expander receiving warm air from the first heat exchanger; and a second heat exchanger having a first plurality of passageways receiving cold air from the expander, the second heat exchanger having a second plurality of passageways receiving supplemental ambient air, the first and second plurality of passageways being proximate each other to effectuate heat transfer and utilize the cold air to cool the supplemental ambient air and provide mixed cool air.

2. The air cooling system of claim 1, wherein the second plurality of passageways include a plurality of fins to provide turbulent flow to the supplemental ambient air.

3. The air cooling system of claim 1, wherein the air cooling system is an open loop system.

4. The air cooling system of claim 1, wherein the first plurality of passageways comprise a plurality of tubes.

5. The air cooling system of claim 1, wherein the second heat exchanger includes a manifold receiving the cold air and distributing the cold air to the first plurality of passageways.

6. The air cooling system of claim 5, wherein the manifold is elongated and includes an inlet end, and wherein the manifold tapers as the manifold extends away from the inlet.

7. The air cooling system of claim 5, wherein the manifold includes an inlet end, and wherein the volume of the manifold decreases in relation to distance from the inlet.

8. The air cooling system of claim 1, wherein the second heat exchanger defines a discharge surface, and wherein the cold air and the supplemental ambient air exit the second heat exchanger proximate the discharge surface.

9. The air cooling system of claim 8, wherein the discharge surface face axially downstream along a pathway of mixed cool air.

10. The air cooling system of claim 8, wherein the first and second passageways extend proximate each other at a location upstream of the discharge surface.

11. The air cooling system of claim 1, wherein the second heat exchanger defines a discharge surface, and wherein the first and second plurality of passageways end proximate the discharge surface.

12. The air cooling system of claim 11, wherein the first and second plurality of passageways end proximate each other to promote mixing of cold air and the supplemental ambient air.

13. The air cooling system of claim 11, wherein the second plurality of passageways are structured to collect moisture proximate the discharge surface.

14. The air cooling system of claim 13, wherein the second plurality of passageways include a plurality of fins, and wherein the moisture flows down along the fins under the force of gravity.

15. The air cooling system of claim 1, wherein the second heat exchanger is structured to cool the supplemental ambient air in two phases including a first phase wherein the supplemental ambient air passes proximate the cold air to effectuate heat transfer, and a second phase wherein both the cold air and the supplemental ambient air exit at a discharge surface structured to mix the cold air and supplemental air to provide cool air.

16. The air cooling system of claim 15, wherein the first phase occurs prior to the second phase.

17. An air cooling system for cooling ambient air comprising:

a compressor receiving ambient air;

a first heat exchanger receiving pressurized air from the compressor;

an expander receiving warm air from the first heat exchanger; and a second heat exchanger receiving cold air from the expander, the second heat exchanger further receiving supplemental ambient air, the second heat exchanger including a discharge surface where the cold air and the supplemental air exit, the second heat exchanger and discharge surface structured to mix the cold air and supplemental air proximate the discharge surface;

wherein the second heat exchanger includes a first plurality of passageways receiving the cold air and a second plurality of passageways receiving the supplemental ambient air, the first and second plurality of passageways being proximate each other to effectuate heat transfer.

18. The air cooling system of claim 17, wherein the second plurality of passageways are structured to collect moisture proximate the discharge surface.

19. The air cooling system of claim 17, wherein the second heat exchanger is structured to utilize the cold air to cool the supplemental ambient air and provide mixed cool air.

20. The air cooling system of claim 17, wherein the second heat exchanger includes a manifold receiving the cold air and distributing the cold air to the first plurality of passageways, the manifold being elongated and including an inlet end, the manifold tapering as the manifold extends away from the inlet.

21. The air cooling system of claim 17, wherein the second heat exchanger is structured to cool the supplemental ambient air in two phases including a first phase wherein the supplemental ambient air passes proximate the cold air to effectuate heat transfer, and a second phase wherein both the cold air and the supplemental ambient air exit at a discharge surface structured to mix the cold air and supplemental air to provide cool air.

22. The air cooling system of claim 21, wherein the first phase occurs prior to the second phase.

23. The air cooling system of claim 17, wherein the discharge surface face axially downstream along a pathway of mixed cool air.

24. The air cooling system of claim 17, wherein the first and second passageways extend proximate each other at a location upstream of the discharge surface.

* * * * *